US006918494B2

(12) United States Patent
Girdler

(10) Patent No.: US 6,918,494 B2
(45) Date of Patent: Jul. 19, 2005

(54) HYDROCYCLONE SEPARATOR PACKAGING

(75) Inventor: Keith J. Girdler, Newbury (GB)

(73) Assignee: Petreco International, Ltd., Rugby (GB)

( * ) Notice: Subject to any disclaimer, the term of this patent is extended or adjusted under 35 U.S.C. 154(b) by 239 days.

(21) Appl. No.: 10/421,128

(22) Filed: Apr. 23, 2003

(65) Prior Publication Data

US 2003/0222003 A1 Dec. 4, 2003

Related U.S. Application Data

(60) Provisional application No. 60/374,922, filed on Apr. 23, 2002.

(51) Int. Cl.[7] ..... B04C 5/02

(52) U.S. Cl. ..... 209/734; 209/732; 209/733; 209/728

(58) Field of Search ..... 271/728, 729, 271/732, 733, 734, 727

(56) References Cited

U.S. PATENT DOCUMENTS

| | | | | |
|---|---|---|---|---|
| 3,386,588 A | * | 6/1968 | Lewis | 210/512.2 |
| 4,019,980 A | | 4/1977 | Beery | |
| 4,148,721 A | * | 4/1979 | Brown et al. | 209/728 |
| 4,163,719 A | | 8/1979 | Macierewicz et al. | |
| 4,437,984 A | | 3/1984 | King et al. | |
| 5,337,899 A | | 8/1994 | Andersson et al. | 209/728 |
| 5,499,720 A | | 3/1996 | Bouchillion et al. | |

FOREIGN PATENT DOCUMENTS

| | | | |
|---|---|---|---|
| WO | WO 89/11339 | 11/1989 | B04C/5/14 |

* cited by examiner

*Primary Examiner*—Donald P. Walsh
*Assistant Examiner*—Kaitlin Joerger
(74) *Attorney, Agent, or Firm*—Madan, Mossman & Sriram P.C.

(57) ABSTRACT

An arrangement of hydrocyclones, resulting in a greater density of hydrocyclones packaged in a given volume. One or more overflow extensions is secured to the overflow portions of one or more hydrocyclones to permit individual hydrocyclones to be placed into an axially staggered arrangement with respect to each other. By keeping the larger hydrocyclone heads from being directly adjacent that of a neighbor's, the maximum diameter of the hydrocyclones no longer becomes a limitation on the proximity of one hydrocyclone to another. The inlet section of one of a group of hydrocyclones is disposed to be adjacent either the separation portion of an adjacent hydrocyclone or an overflow extension, thereby permitting denser packaging. In another aspect, groups of axially staggered hydrocyclones are axially offset from and intermeshed with one another, permitting greater density in packaging. The groups of hydrocyclones are arranged into building blocks of three hydrocyclones each such that the axial ends of the individual hydrocyclones form a triangle, most preferably an equilateral triangle.

21 Claims, 4 Drawing Sheets

HYDROCYCLONE SEPARATOR PACKAGING

The present application claims the priority of U.S. Provisional Patent Application Ser. No. 60/374,922 filed Apr. 23, 2002.

BACKGROUND OF THE INVENTION

1. Field of the Invention

The invention relates generally to an improved arrangement for packaging multiple hydrocyclone separators, especially those used for petroleum fluid processing.

2. Description of the Related Art

The overall construction and manner of operation of hydrocyclone separators is well known. A typical hydrocyclone includes an elongated tapered separation chamber or circular cross-section, which decreases in cross-sectional size from a large overflow and input end to an underflow end. An overflow or reject outlet for the lighter fraction is provided at the base of the conical chamber while the heavier underflow or accept fraction of the suspension exits through an axially arranged underflow outlet at the opposite end of the conical chamber.

Liquids and suspended particles are introduced into the chamber via one or more tangentially directed inlets. These are adjacent to the overflow end of the separation chamber to create a fluid vortex therein. The centrifugal forces created by this vortex throw denser fluids and particles in suspension outwardly toward the wall of the conical chamber, thus giving a concentration of denser fluids and particles adjacent thereto, while the less dense fluids are brought toward the center of the chamber. As the denser fluids and particles continue to spiral towards the small end of the conical chamber, the lighter fractions are forced to move by differential forces in the reverse direction towards the reject outlet. The lighter fractions are thus carried outwardly through the overflow outlet. The heavier particles continue to spiral along the interior wall of the hydrocyclone and eventually pass outwardly via the underflow outlet.

The fluid velocities within a hydrocyclone are high enough that the dynamic forces produced therein are sufficiently high to overcome the effect of any gravitational forces on the performance of the device. Hydrocyclones may therefore be arranged in various physical orientations without affecting performance. Hydrocyclones are commonly arranged in large banks of several dozen or even several hundred hydrocyclones with suitable intake, overflow, and underflow assemblies arranged for communication with the intake, overflow and underflow openings respectively of the hydrocyclones.

Earlier separator systems involving large numbers of hydrocyclone separators commonly employed complex systems of intake, overflow, and underflow pipes or conduits which occupied a substantial amount of space and which required costly and complex support structures for the piping systems involved. It is desired to reduce the space occupied by hydrocyclone assemblies and provide a relatively compact arrangement, especially in the petroleum industry, where offshore platform applications and ship-based installations put a premium on space. A compact arrangement would also minimize the cost of the equipment and improve flow distribution to the hydrocyclone inlets.

The inventor has realized that a related limitation of existing hydrocyclone assembly design is that of flow distribution of fluid into the individual hydrocyclones of an assembly where the hydrocyclones are disposed in parallel within a conventional hydrocyclone vessel. In this type of arrangement, exemplified in FIG. 1, the hydrocyclones 18 are all contained within a single vessel 12. Fluid is injected into a chamber 28 of the vessel 12 via a single inlet nozzle 30. As a result of differential pressure, the fluid passes from the chamber 28 into the inlets 31 of the individual hydrocyclones 18. Using current designs, the inlets 31 of the individual hydrocyclones are all disposed at approximately the same longitudinal location within the chamber 28. The concentration of fluid inlets 31 in the same location results in poor fluid distribution that may actually decrease the effectiveness of the hydrocyclone assembly 10 by limiting differential pressure in the area where the inlets 31 are concentrated. It would be desirable to provide improved flow distribution to the hydrocyclone inlets.

One variation of a prior art arrangement of hydrocyclones placed the hydrocyclones in vertically spaced apart layers, with the hydrocyclones of each layer being disposed in radial arranged arrays with common intake, overflow and underflow piping communicating with the hydrocyclones of the several layers. This arrangement saved the floor space area required for the hydrocyclones above the equipment floor while the intake, overflow and underflow piping was installed beneath the floor together with the necessary valves on each unit for adjusting pressures and for isolating individual hydrocyclones.

Alternative forms of modular hydrocyclone separator systems have been devised in an effort to overcome problems with the layered system. These new systems involve vertically disposed, suitably spaced intake, overflow and underflow headers. Individual hydrocyclones are connected to these headers and a positioned in generally vertical planes in substantially horizontal positions, one above the other. Thus, operator control of the system is facilitated and the operation of individual hydrocyclones can be observed.

Prior methods of arranging multiple hydrocyclones have provided only limited results in the goal of reducing the volume of space taken up by the hydrocyclones. U.S. Pat. No. 4,437,984 shows hydrocyclones arranged vertically, with the hydrocyclones parallel to each other. U.S. Pat. No. 4,163,719 shows hydrocyclones stacked in angled vertical arrays, where each hydrocyclone body is roughly parallel to other hydrocyclones in the same vertical array. U.S. Pat. No. 4,019,980 also shows hydrocyclones stacked in angled vertical arrays, where each hydrocyclone body is roughly parallel to other hydrocyclones in the same vertical array, and also shows multiple arrays sharing common input piping. U.S. Pat. No. 5,499,720 shows hydrocyclones arranged in a radial pattern, with the narrowing bodies of the hydrocyclones adjacent to each other.

It is desired to have hydrocyclones packaged as tightly together as possible so as to take up the minimum amount of space. For offshore platform and ship-based installations, volume of space is at a premium and greater efficiencies are desired for the use of a given volume of space.

Hydrocyclone separators are usually conical in shape, with a wide overflow end and a narrowed underflow end. Placing individual hydrocyclone separators parallel to each other requires that the distance between the center of any two hydrocyclones be at a minimum equal to the combined radii of the two hydrocyclones. Where the hydrocyclones may need to be removed for replacement or maintenance, additional spacing is required to allow for free movement of the hydrocyclones, or even for mounting elements. It is desired to reduce the amount of space between hydrocyclones to allow for more hydrocyclones to occupy a given space.

SUMMARY OF THE INVENTION

The present invention provides an improved arrangement of hydrocyclones, resulting in a greater density of hydrocyclones packaged in a given volume. One or more overflow extensions is secured to the overflow portions of one or more hydrocyclones to permit individual hydrocyclones to be placed into an axially staggered arrangement with respect to each other. By keeping the larger hydrocyclone heads from being directly adjacent that of a neighbor's, the maximum diameter of the hydrocyclones no longer becomes a limitation on the proximity of one hydrocyclone to another. In preferred embodiments described herein, the inlet section of one of a group of hydrocyclones is disposed to be adjacent either the separation portion of an adjacent hydrocyclone or an overflow extension, thereby permitting denser packaging and improved flow distribution.

In another aspect of the present invention, groups of axially staggered hydrocyclones are axially offset from and intermeshed with one another, permitting greater density in packaging. In a preferred embodiment, the groups of hydrocyclones are arranged into groups of three hydrocyclones each such that the axial ends of the individual hydrocyclones form a triangle, most preferably an equilateral triangle.

BRIEF DESCRIPTION OF THE DRAWINGS

For detailed understanding of the invention, reference is made to the following detailed description of the preferred embodiments, taken in conjunction with the accompanying drawings in which reference characters designate like or similar elements throughout the several figures of the drawings.

DETAILED DESCRIPTION OF THE PREFERRED EMBODIMENTS

Figure 1:
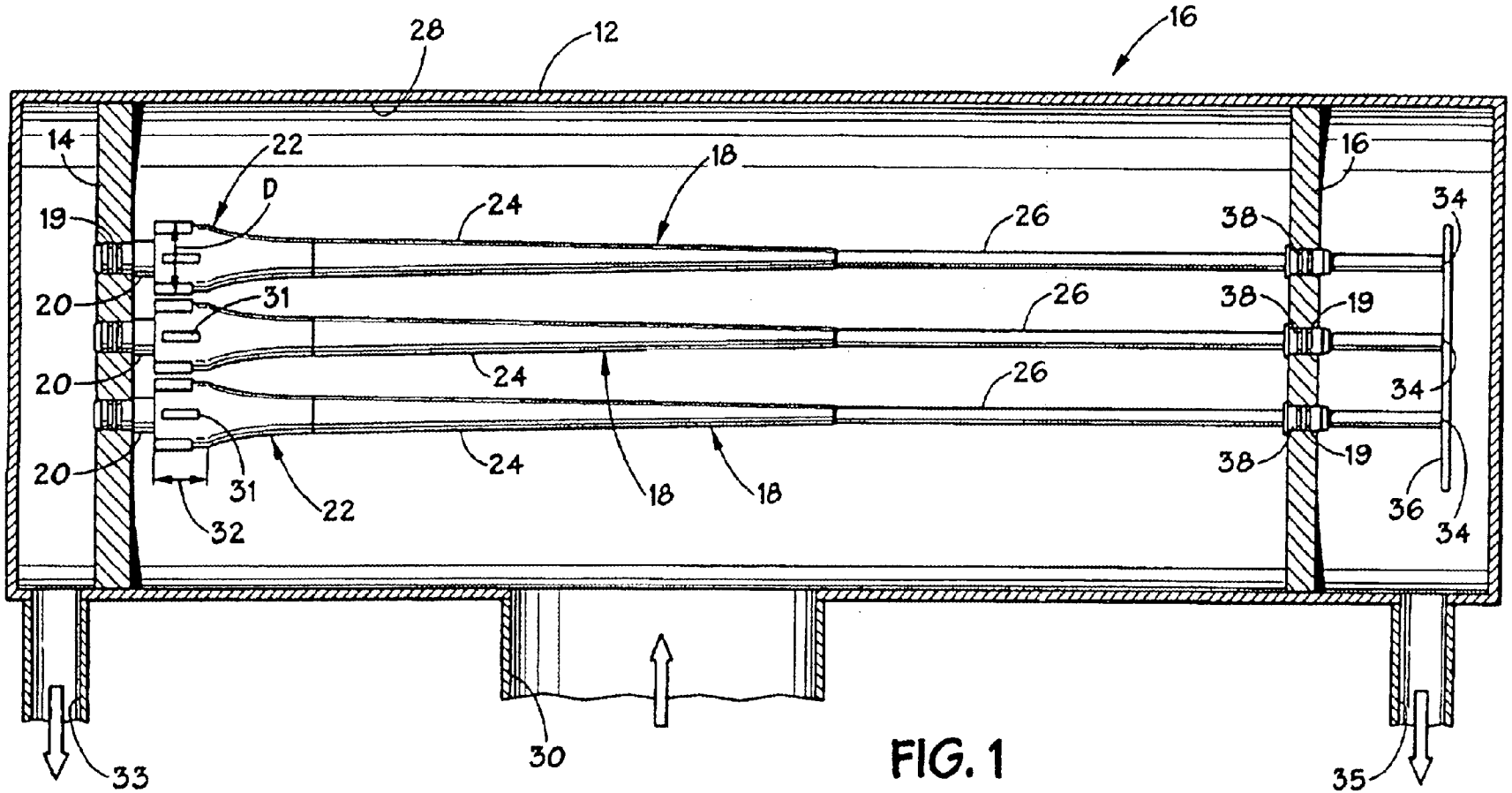
FIG. 1 (PRIOR ART)
FIG. 1 is a side view of an exemplary prior art hydrocyclone assembly.

A hydrocyclone separation assembly includes a plurality of individual hydrocyclones. Referring first to FIG. 1, an exemplary prior art hydrocyclone separation assembly 10 is shown that includes an outer cylindrical vessel 12 that retains a pair of support members, or plates, 14, 16, proximate its axial ends that support several hydrocyclones 18 arranged in a substantially parallel relation with respect to one another. Opposite end portions of the hydrocyclones 18 are disposed through apertures 19 in the first and second support plates 14, 16.

Each hydrocyclone 18 comprises a single tubular body with an overflow (reject) section 20, an inlet section 22, a tapered separation chamber section 24, and an underflow (tail pipe) section 26. As is known in the art, a fluid or fluid/solid mixture is introduced under pressure into a chamber 28 defined within the outer vessel 12 via a single inlet (shown schematically as nozzle 30). The inlet 30 is typically a large diameter inlet that is located proximate the longitudinal middle of the vessel 12 and delivers fluid flow that is at least equal to the individual capacity of the hydrocyclones 18 multiplied times the number of hydrocyclones 18. The fluid mixture then enters the individual inlet sections 22 of each individual hydrocyclone 18 via lateral inlet ports 31. The hydrocyclones 18 separate the fluid mixture into constituent fluid components in a well known manner. The lighter fraction of fluid exits the overflow outlet 20 of the hydrocyclone 12 and then exits the vessel 12 via reject nozzle 33. The heavier fluid fraction exits each hydrocyclone 12 through the underflow section 26 and exits the vessel 12 via underflow nozzle 35.

It is noted that the inlet section 22 of each hydrocyclone 18 includes a substantially cylindrical chamber portion 32, which presents the largest cross-sectional diameter "D" of any portion of the hydrocyclone 18. In the prior assembly 10 depicted in FIG. 1, the inlet sections 22 of neighboring hydrocyclones 18 are positioned directly adjacent to one another such that the axial ends 34 of the underflow section 26 of each hydrocyclone 18 are substantially aligned in a plane 36 that is normal to the longitudinal axes of the hydrocyclones 18. As a result of this positioning, it can be seen that minimum spacing between the hydrocyclones 18 is constrained by the diameter D of the inlet section 22. A trunnion 38 is fixedly secured to the radial exterior of the underflow section 26 of each hydrocyclone 18. The trunnions 38 provide an interference fit within the support plate 16.

Figure 2:
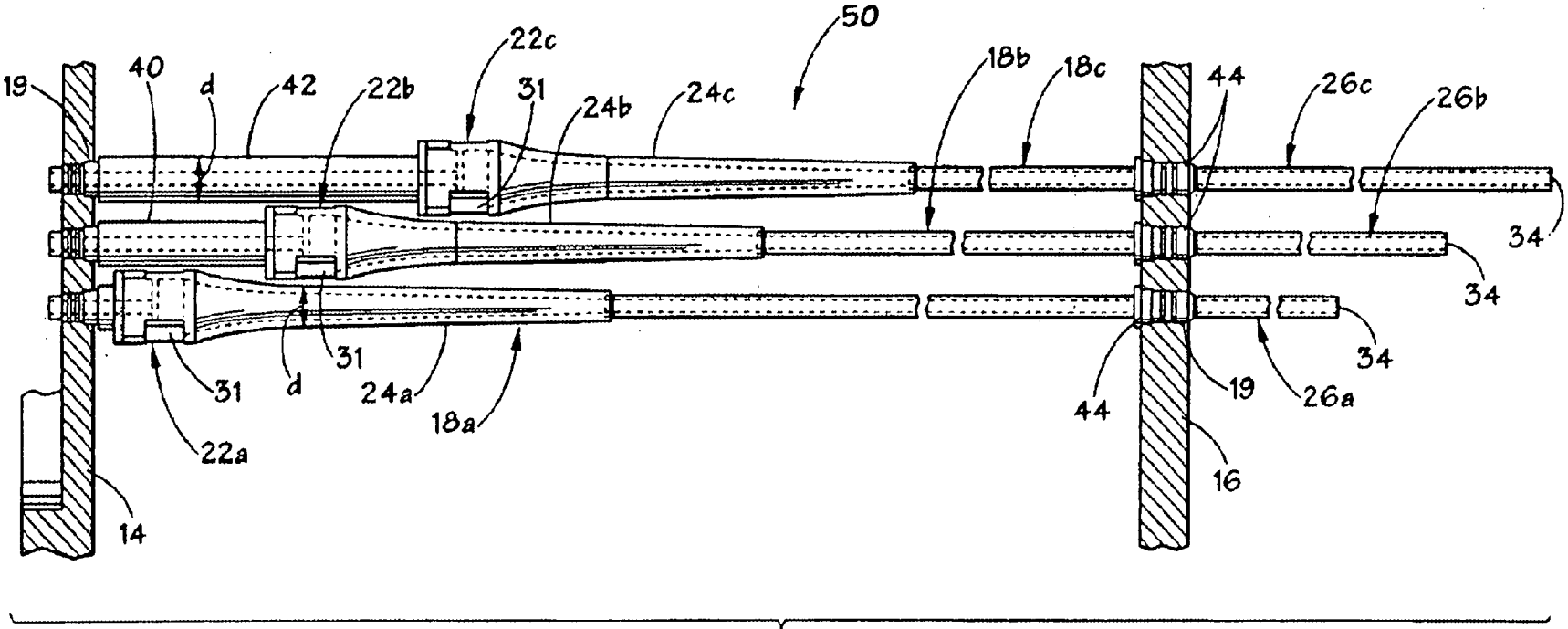
FIG. 2 is a side view of a currently preferred embodiment for a hydrocyclone assembly constructed in accordance with the present invention, showing three hydrocyclone separators.

Referring now to FIG. 2, there is shown a portion of an exemplary hydrocyclone separator assembly 50 that is constructed in accordance with the present invention. A set of three hydrocyclones 18*a*, 18*b*, and 18*c* are depicted, although it should be understood that in practice there is typically a greater number of hydrocyclones 18. The hydrocyclones 18*a*, 18*b*, and 18*c* are constructed in essentially the same manner as the hydrocyclones 18 described earlier. The second hydrocyclone 18*b* is provided with an overflow extension 40 that extends between and interconnects the inlet portion 22*b* with the support plate 14. The third hydrocyclone 18*c* is also provided with an overflow extension 42 that extends between and interconnects the inlet portion 22*c* with the support plate 14. The overflow extension 42 has a length that is greater than the length of the overflow extension 40. Both the overflow extensions 40 and 42 are tubular members that permit fluid to flow from the overflow outlet 20 through the support member 14 and into an overflow receptacle (not shown) of a type known in the art. It is also noted that the overflow extensions 40 and 42 each have a diameter "d" that is less than the diameter D of the inlet section and preferably approximates the smaller diameter "d" of a portion of a separation section 26. The underflow sections 26*a*, 26*b*, and 26*c* are provided with slidable trunnions 44 that are moveable axially along the length of the underflow sections 26*a*, 26*b*, and 26*c*. The trunnions 44 form a secure interference fit with the support plate 16.

The axially staggered arrangement of the present invention has the effect of axially displacing the respective inlet sections 22*a*, 22*b*, and 22*c* of the hydrocyclones 18*a*, 18*b*, and 18*c* with respect to one another so that the inlet section of one hydrocyclone lies adjacent the separation chamber section 24*a*, 24*b*, 24*c* of a neighboring hydrocyclone. Specifically, the inlet section 22*c* of the third hydrocyclone 18*c* lies adjacent the separation chamber section 24*b* of the second hydrocyclone 18*b*, while the inlet section 22*b* of the second hydrocyclone 18*b* lies adjacent the separation chamber section 24*a* of the hydrocyclone 24*a*. It should be understood that the packaging techniques and methods of the present invention may be applied to any model of hydrocyclone having an inlet/head section which is greater in diameter than the underflow portion. Examples include "K" hydrocyclone liners having a removable involute, as well as those hydrocyclone liner styles known within the industry as "Km," "Kq," and "Gm."

Additionally, the presence of the overflow extensions 40, 42, and their reduced diameter (as compared to the inlet sections 22) accommodates neighboring inlet sections 22. It can be seen from FIG. 2 that the inlet section 22*a* of the hydrocyclone 18*a* lies adjacent the overflow exntension 40, and the inlet section 22*b* of the hydrocyclone 18*b* lies adjacent the overflow extension 42. It is noted that, in this axially staggered packaging arrangement, the axial ends 34 of the underflow sections 26*a*, 26*b*, and 26*c* do not lie in a plane that is normal to the axes of the hydrocyclones 18, such as plane 36 depicted previously. Instead, the ends 34 are staggered.

The axially staggered arrangement also provides improved flow distribution within the vessel 12 of the hydrocyclone assembly 10. The fluid inlets 31 of the hydrocyclones 18*a*, 18*b*, 18*c* are axially spaced apart from one another, resulting in a higher effective differential pressure for each of the inlets 31. As a result, flow distribution within the vessel 12 is improved.

It is preferred that the packaging of the hydrocyclones 18*a*, 18*b*, and 18*c* be such that the inlet sections 22*a*, 22*b*, and 22*c* be in contact with or in very close proximity to the respective adjacent separation chamber section 24 or overflow extension 40 or 42. The hydrocyclones 18*a*, 18*b*, and 18*c* may be aligned in a straight line, as FIG. 2 depicts. Alternatively, the hydrocyclones 18*a*, 18*b*, and 18*c* may be displaced in a second direction (Z axis) to result in a further space savings as is described with respect to FIG. 3.

Figure 3:
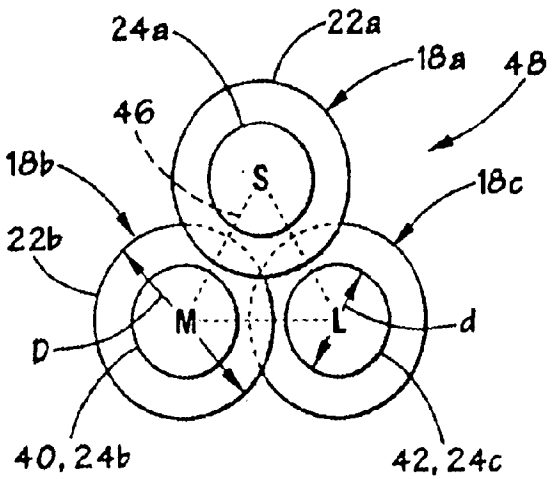
FIG. 3 is a schematic end view of an exemplary layout for a packaging arrangement in accordance with the present invention showing three hydrocyclones that are axially staggered and axially offset.

Referring now to FIG. 3, there is shown a schematic end-on view of three hydrocyclones 18*a*, 18*b*, and 18*c* that are packaged in an arrangement wherein the three hydrocyclones are axially staggered, as described earlier with respect to FIG. 2, and further axially offset from one another. As used herein, the term "axially offset" means that the axes of the hydrocyclones 18*a*, 18*b*, and 18*c* do not form a straight line and, instead, form a triangle, most preferably the equilateral triangle 46 depicted in FIG. 3. The letter "S," to denote a "short" length, is used to label hydrocyclone 18*a*, indicating that the overall length of that hydrocyclone is less than the length of the hydrocyclones 18*b* and 18*c* when considered with their attached overflow extensions 40, 42, respectively. The letters "M" denoting "medium" length and "L" denoting "long" length are used to label the hydrocyclones 18*b* and 18*c*, respectively.

In the preferred embodiment depicted in FIG. 3, the packaging is such that the outer diametrical surface of the inlet section 22*a* of the first hydrocyclone 18*a* contacts or is closely proximate to the overflow extension 40 associated with the second hydrocyclone 18*b* and the overflow extension 42 associated with the third hydrocyclone 18*c*. The outer diametrical surface of the inlet section 22*b* of the second hydrocyclone 18*b* contacts or is closely proximate to the separation chamber portion 24*a* of the first hydrocyclone 18a as well as the overflow extension 42 associated with the third hydrocyclone 18*c*. The outer diametrical surface of the inlet portion 22*c* of the third hydrocyclone 18*c* contacts or is closely proximate to the separation sections 24*a* and 24*b* of the first and second hydrocyclones 18*a* and 18*b*, respectively. The three hydrocyclones 18*a*, 18*b*, 18*c* are preferably maintained together into the triangular configuration shown in FIG. 3 by corresponding patterns of apertures 19 within the first and second support plates 14, 16. In other words, the apertures 19 are disposed in a triangular configuration within the respective support plates 14, 16 and are of such spacing from one another that they retain the hydrocyclones 18*a*, 18*b*, and 18*c* in the configuration depicted in FIG. 3. The triangular formation depicted in FIG. 3 results in a triangular bundle, generally indicated as 48, in which the hydrocyclones 18*a*, 18*b*, 18*c* are intermeshed with one another to reduce the interstitial space between the hydrocyclones, thereby further enhancing the ability to package the hydrocyclones 18*a*, 18*b*, 18*c* densely within an assembly.

Figure 4:
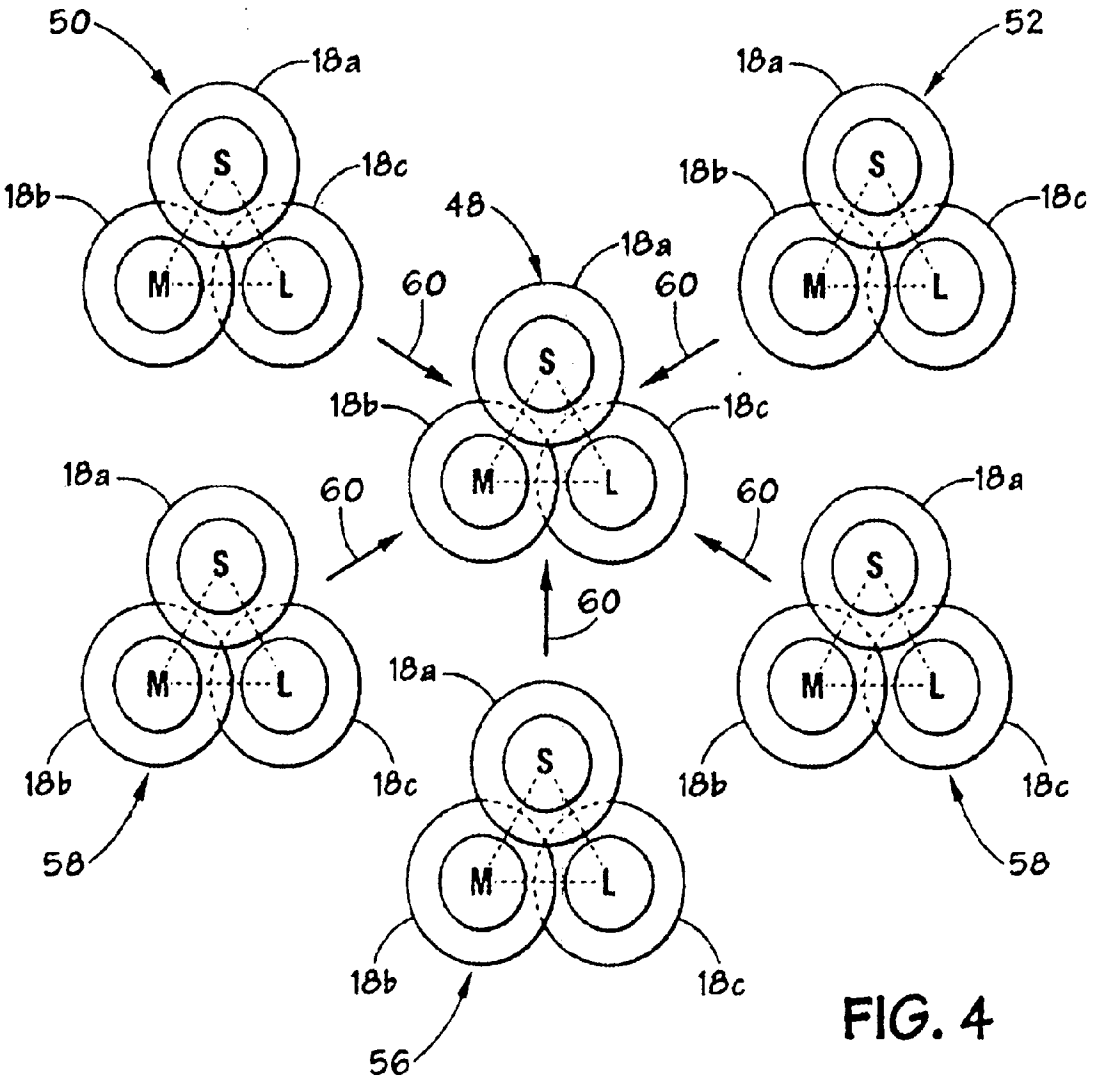
FIGS. 4 and 5 are schematics depicting multiple triangular bundles of hydrocyclones being packaged to provide an intermeshed grouping of hydrocyclones.
Figure 5:
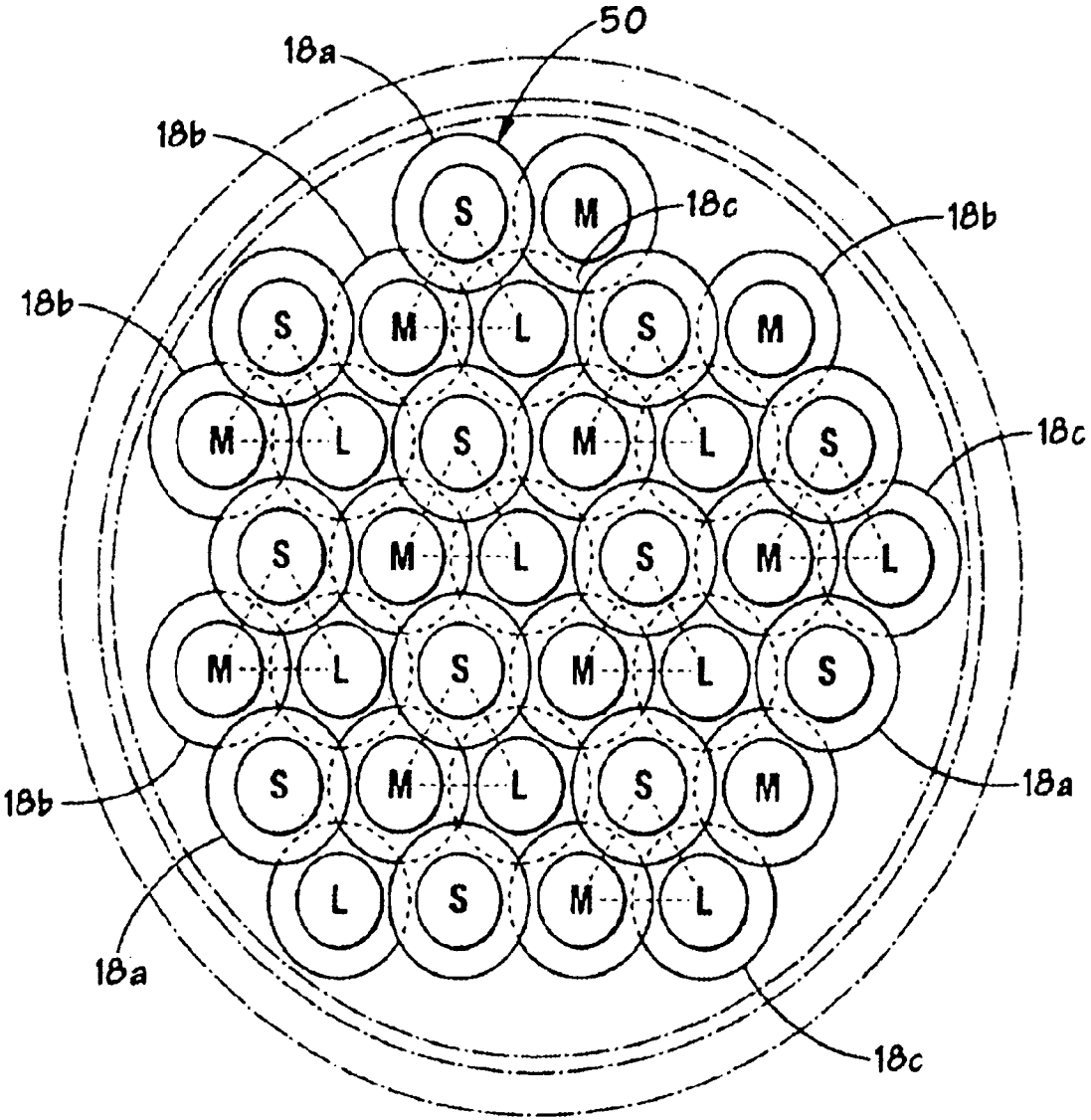

The triangular bundle 48 provides a basic building block that may be repeated within an assembly in order to maximize packaging of hydrocylones within a given volume or area. FIGS. 4 and 5 illustrate this. The exemplary hydrocyclone bundle 48 described above is packaged with other, like-constructed bundles 50, 52, 54, 56, and 58. The spacing between the bundles 48, 50, 52, 54, 56, and 58 is exaggerated in FIG. 4 for clarity. It should be understood that, in fact, these bundles are all placed either into contact with or in very close proximity to one another, as indicated that the arrows 60. The neighboring bundles can then be intermeshed with one another in the same manner as the individual hydrocyclones 18*a*, 18*b*, and 18*c* are. In other words, the "S" hydrocyclone 18a from the bundle 48 intermeshes with the axially staggered "M" hydrocyclone 18*b* from bundle 52 and "L" hydrocyclone 18*c* from bundles 50. It can be appreciated, then, that the advantages of the present invention may be realized in a three-dimensional manner. Where the advantages of axially staggering hydrocyclones is clearly shown in a two-dimensional array in FIGS. 2, 3 and 4 show that a greater density of hydrocyclones may also be achieved by implementing an axially offset relationship along a third dimension.

Those of skill in the art will recognize that numerous modifications and changes may be made to the exemplary designs and embodiments described herein and that the invention is limited only by the claims that follow and any equivalents thereof.

What is claimed is:

1. A hydrocyclone separation assembly comprising:

first and second hydrocyclones disposed in a generally parallel relation to one another, each of said hydrocylones comprising a tubular body with an inlet section having a first diameter and a separation section having a second diameter, wherein the first diameter is greater than the second diameter;

a first support member for supporting the inlet sections of the first and second hydrocyclones;

a first spacer member disposed between and interconnecting the first support member and the inlet section of the second hydrocyclone, thereby permitting the inlet section of the second hydrocyclone to lie adjacent the separation section of the first hydrocyclone.

2. The hydrocyclone separation assembly of claim 1 wherein the first spacer member comprises a tubular overflow header that defines a fluid passage therethrough.

3. The hydrocyclone separation assembly of claim 1 further comprising:

a second support member for supporting the separation sections of the first and second hydrocyclones; and a trunnion member moveably disposed upon the separation section of each of the first and second hydrocyclones and in engaging contact with the second support member.

4. The hydrocyclone separation assembly of claim 1 further comprising:

a third hydrocyclone with an inlet section having a first diameter and a separation section having a second diameter, wherein the first diameter is greater than the second diameter, the third hydrocyclone being disposed in a generally parallel relation with the first and second hydrocyclones; and a second spacer member having a length that is greater than that of the first spacer member, the second spacer member being disposed between and interconnecting the first support member and the inlet section of the third hydrocyclone, thereby permitting the inlet section of the third hydrocyclone to lie adjacent the separation section of the second hydrocyclone.

5. The hydrocyclone separation assembly of claim 4 wherein the first axial ends of the first, second, and third hydrocyclones are arranged in an axially offset manner to form a triangle.

6. The hydrocyclone separation assembly of claim 5 wherein the triangle is an equilateral triangle.

7. A hydrocyclone separation assembly comprising:

a plurality of hydrocyclones, each hydrocyclone having an inlet section having a first diameter and a separation section having a second diameter, wherein the first diameter is greater than the second diameter;

the plurality of hydrocyclones being retained from a support member within a hydrocyclone vessel; and the plurality of hydrocyclones being axially staggered with respect to one another such that the inlet section of at least one of said plurality of hydrocyclone lies adjacent the separation section of another of said hydrocyclones.

8. The hydrocyclone separation assembly of claim 7 further comprising an overflow extension associated with the inlet section of at least one of said plurality of hydrocyclones.

9. The hydrocyclone separation assembly of claim 7 wherein there are at least three hydrocyclones.

10. The hydrocyclone separation assembly of claim 9 further comprising a first overflow extension member extending between the inlet section of one of said at least three hydrocyclones and the support member.

11. The hydrocyclone separation assembly of claim 10 wherein the inlet section of one of said at least three hydrocyclones lies adjacent the first overflow extension member.

12. The hydrocyclone separation assembly of claim 10 further comprising a second overflow extension member extending between the inlet section of a second of said at least three hydrocyclones and the support member, the second overflow extension being axially longer than the first overflow extension.

13. The hydrocyclone separation assembly of claim 10 wherein the inlet section of one of said at least three hydrocyclones lies adjacent the second overflow extension member.

14. The hydrocyclone separation assembly of claim 9 wherein the at least three hydrocyclones are axially offset from one another.

15. The hydrocyclone separation assembly of claim 14 wherein the axially offset arrangement results in axial ends of the at least three hydrocyclones forming an equilateral triangle.

16. A hydrocyclone separation assembly comprising:

a support member within a hydrocyclone vessel;

three hydrocyclones disposed in a generally parallel relation to one another and support ed by said support member, each of the hydrocyclones comprising an inlet section having a first diameter and a separation section presenting an axial end and having a second diameter, wherein the first diameter is greater than the second diameter;

the three hydrocyclones each being axially staggered from one another such that the inlet section of at least one of said hydrocyclone lies adjacent the separation section of another of said hydrocyclones; and the three hydrocyclones being axially offset from one another such that the axial ends of the three hydrocyclones form a triangle.

17. The hydrocyclone separation assembly of claim 16 further comprising a first overflow extension member interconnecting the inlet section of a first of said three hydrocyclones to said support member, the first overflow extension member being of a length that permits the inlet section of said first hydrocyclone to lie adjacent the separation section of a second of said hydrocyclones while the inlet section of said second hydrocyclone lies adjacent said first overflow extension member.

18. The hydrocyclone separation assembly of claim 17 further comprising a second overflow extension member interconnecting the inlet section of a third of said three hydrocyclones to said support member, the second overflow extension member being of a length that permits the inlet section of said third hydrocyclone to lie adjacent the separation section of the first of said hydrocyclones while the inlet section of said first hydrocyclone lies adjacent said second overflow member.

19. The hydrocyclone separation assembly of claim 16 further comprising:

a second support member within the hydrocyclone vessel for supporting the axial ends of the three hydrocyclones; and a trunnion radially disposed about each of the three hydrocyclones proximate the axial end, the trunnion being secured within the second support member but axially moveable along a portion of the hydrocyclone.

20. The hydrocyclone separation assembly of claim 16 wherein the triangle is an equilateral triangle.

21. The hydrocyclone separation assembly of claim 16 wherein the axially staggered arrangement provides improved flow distribution.

* * * * *

UNITED STATES PATENT AND TRADEMARK OFFICE

CERTIFICATE OF CORRECTION

PATENT NO. : 6,918,494 B2
DATED : July 19, 2005
INVENTOR(S) : Keith J. Girdler

It is certified that error appears in the above-identified patent and that said Letters Patent is hereby corrected as shown below:

Column 5,
Line 12, delete “exntension” and insert -- extension --.

Column 6,
Line 32, delete “FIGS.” and insert -- FIG --.
Line 32, after “2”, and before “3”, insert -- FIGS. --.

Column 8,
Line 11, delete “support ed” and insert -- supported --.

Signed and Sealed this

Fourteenth Day of February, 2006

JON W. DUDAS
*Director of the United States Patent and Trademark Office*